US012139363B2

(12) United States Patent
Okano

(10) Patent No.: US 12,139,363 B2
(45) Date of Patent: Nov. 12, 2024

(54) MEDIUM EJECTING APPARATUS INCLUDING MEDIUM REGULATING MEMBER PROVIDED SO AS TO SWING AND PIVOT

(71) Applicant: PFU LIMITED, Kahoku (JP)

(72) Inventor: Shigeharu Okano, Kahoku (JP)

(73) Assignee: PFU LIMITED, Kahoku (JP)

( * ) Notice: Subject to any disclaimer, the term of this patent is extended or adjusted under 35 U.S.C. 154(b) by 136 days.

(21) Appl. No.: 17/452,225

(22) Filed: Oct. 25, 2021

(65) Prior Publication Data

US 2022/0169473 A1 Jun. 2, 2022

(30) Foreign Application Priority Data

Nov. 30, 2020 (JP) ..... 2020-198287

(51) Int. Cl.
*B65H 31/26* (2006.01)
*B65H 29/14* (2006.01)
(Continued)

(52) U.S. Cl.
CPC ..... *B65H 31/26* (2013.01); *B65H 29/14* (2013.01); *B65H 29/52* (2013.01); *B65H 31/20* (2013.01);
(Continued)

(58) Field of Classification Search
CPC ..... B65H 31/26; B65H 29/14; B65H 29/52; B65H 31/20; B65H 2402/30;
(Continued)

(56) References Cited

U.S. PATENT DOCUMENTS 5,260,759 A * 11/1993 Kobayashi ..... B65H 31/26 271/220
8,485,523 B2 * 7/2013 Kimura ..... B65H 33/08 271/220
2006/0237900 A1 * 10/2006 Sekiyama ..... B65H 29/14 271/220

FOREIGN PATENT DOCUMENTS

JP 61007171 A * 1/1986
JP H09-255210 A 9/1997
(Continued)

OTHER PUBLICATIONS

Japanese Office Action dated Jul. 2, 2024 regarding Japanese Patent Application No. 2020-198287 corresponding to U.S. Appl. No. 17/452,225 (3 pages) with English Translation (5 pages).
(Continued)

*Primary Examiner* — Howard J Sanders
(74) *Attorney, Agent, or Firm* — LEWIS ROCA ROTHGERBER CHIRISTIE LLP

(57) ABSTRACT

A medium ejecting apparatus includes medium ejecting apparatus includes an ejection roller to eject a medium, a tray to load the medium ejected by the ejection roller, a medium regulating member provided with a load pressing portion on a front-end side thereof to apply a load to the medium ejected on the tray, and provided with an engaging portion on a base portion side opposite to the front-end portion, and a holding member provided with an engaged portion to engage with the engaging portion, to hold the medium regulating member in such a way that the medium regulating member can swing in a vertical direction with respect to an upper surface of the tray, and pivot along a rotation axis in a direction from the base side toward the front-end portion side, according to the ejection of the medium.

6 Claims, 14 Drawing Sheets

(51) Int. Cl.
*B65H 29/52* (2006.01)
*B65H 31/20* (2006.01)

(52) U.S. Cl.
CPC .... *B65H 2402/30* (2013.01); *B65H 2404/721* (2013.01); *B65H 2404/725* (2013.01)

(58) Field of Classification Search
CPC ..... B65H 2404/721; B65H 2404/725; B65H 2404/693
See application file for complete search history.

(56) References Cited

FOREIGN PATENT DOCUMENTS

| | | | | |
|---|---|---|---|---|
| JP | 2001-31259 | A | | 2/2001 |
| JP | 2011235970 | A | * | 11/2011 |
| JP | 2015-229549 | A | | 12/2015 |
| JP | 2017-193392 | A | | 10/2017 |

OTHER PUBLICATIONS

Japanese Office Action dated Sep. 10, 2024 regarding Japanese Patent Application No. 2020-198287 corresponding to U.S. Appl. No. 17/452,225 (3 pages) with English Translation (5 pages).

* cited by examiner

MEDIUM EJECTING APPARATUS INCLUDING MEDIUM REGULATING MEMBER PROVIDED SO AS TO SWING AND PIVOT

CROSS-REFERENCE TO RELATED APPLICATIONS

This application is based upon and claims the benefit of priority of prior Japanese Patent Application No. 2020-198287, filed on Nov. 30, 2020, the entire contents of which are incorporated herein by reference.

TECHNICAL FIELD

Embodiments discussed in the present specification relate to medium ejection.

BACKGROUND

Recently, a medium ejecting apparatus such as a scanner, is required to convey, image and eject various types of media such as a business card, a receipt, a Plain Paper Copier (PPC) paper, a passport. When a plurality of media are sequentially conveyed and ejected by the medium ejecting apparatus, the user typically aligns the front-ends of the ejected media to organize the imaged media. In order for the user to easily align the front-ends of the media, positions of the medium ejected on the tray, particularly the medium smaller than a particular size, are desired to be aligned in the medium ejecting apparatus.

A discharge sheet loading apparatus including a document holding member having a holding portion to hold a sheet ejected on a discharge document stacking tray, a base portion located above the discharge document stacking tray, and a node portion provided between the holding portion and the base portion is disclosed (Japanese Unexamined Patent Publication (Kokai) No. 2015-229549). In this discharge sheet loading apparatus, the holding portion can be rotated in a sheet loading direction of the discharge document stacking tray, and can be swung in a direction along a document loading surface of the discharge document stacking tray by the node portion.

SUMMARY

According to some embodiments, a medium ejecting apparatus includes an ejection roller to eject a medium, a tray to load the medium ejected by the ejection roller, a medium regulating member provided with a load pressing portion on a front-end side thereof to apply a load to the medium ejected on the tray, and provided with an engaging portion on a base portion side opposite to the front-end portion, and a holding member provided with an engaged portion to engage with the engaging portion, to hold the medium regulating member in such a way that the medium regulating member can swing in a vertical direction with respect to an upper surface of the tray, and pivot along a rotation axis in a direction from the base side toward the front-end portion side, according to the ejection of the medium.

DESCRIPTION OF EMBODIMENTS

It is to be understood that both the foregoing general description and the following detailed description are exemplary and explanatory, and are not restrictive of the invention, as claimed.

Hereinafter, a medium ejecting apparatus according to an embodiment, will be described with reference to the drawings. However, it should be noted that the technical scope of the invention is not limited to these embodiments, and extends to the inventions described in the claims and their equivalents.

Figure 1:
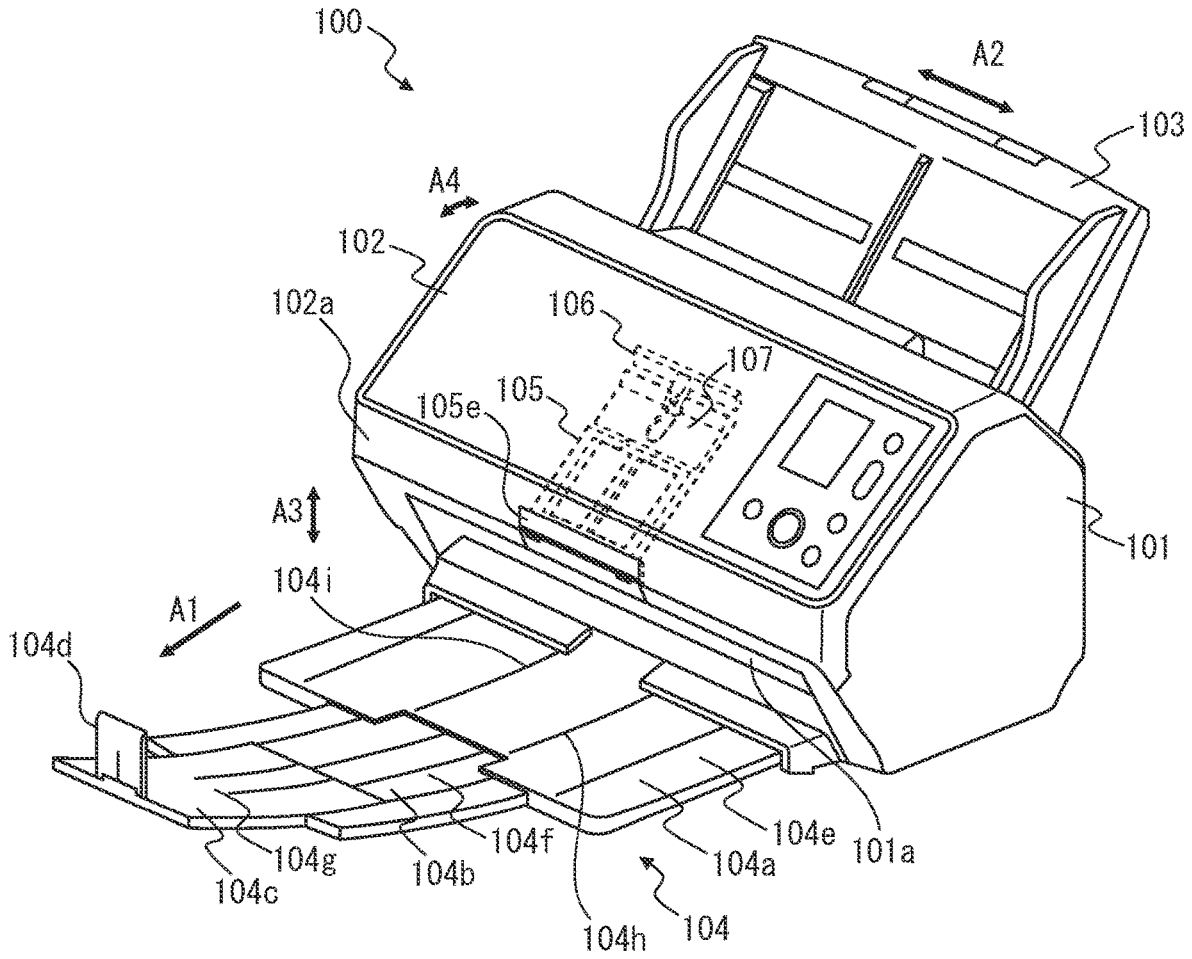
FIG. 1 is a perspective view illustrating a medium ejecting apparatus 100 according to an embodiment.
Figure 2:
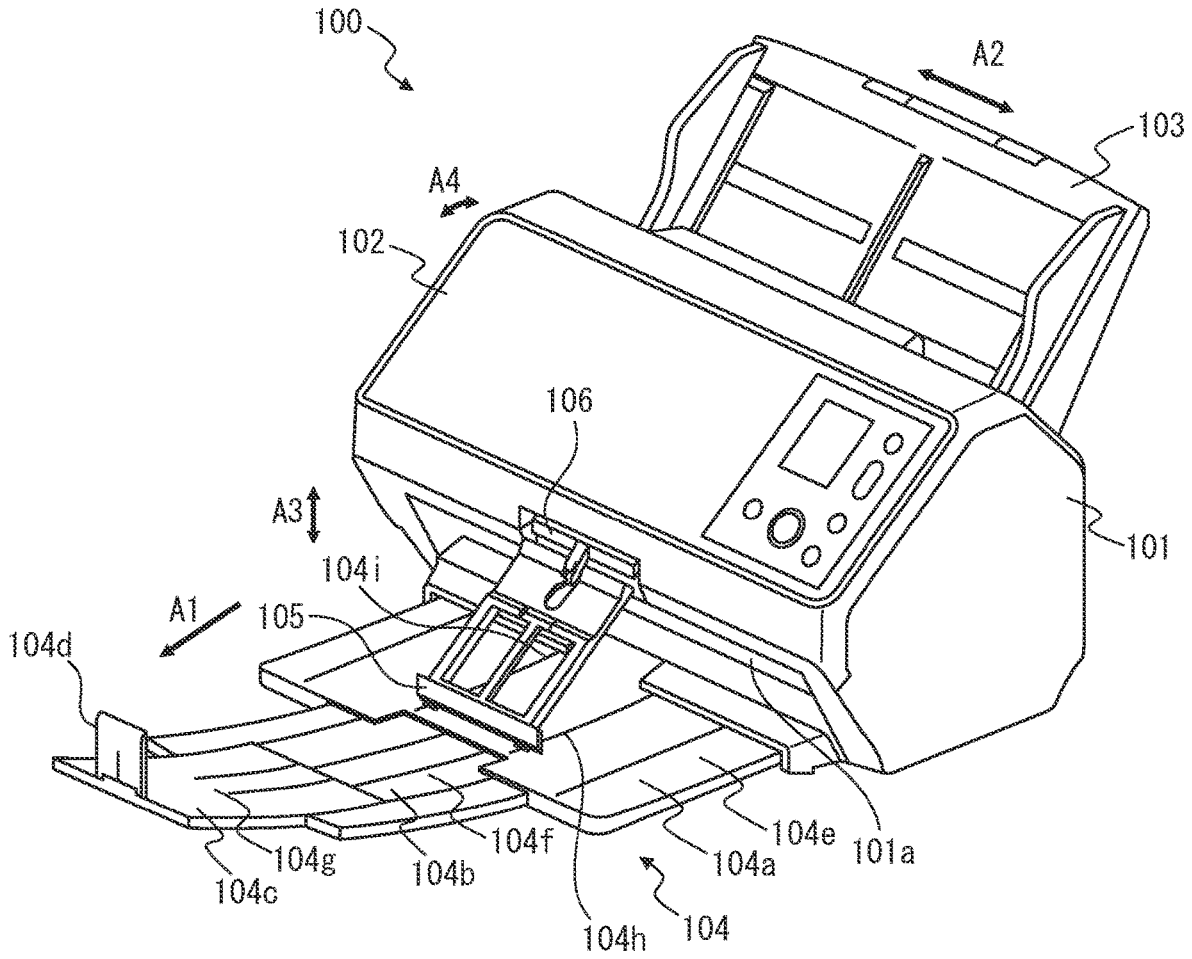
FIG. 2 is a perspective view illustrating the medium ejecting apparatus 100 according to an embodiment.

FIGS. 1 and 2 are perspective views illustrating a medium ejecting apparatus 100 configured as an image scanner. FIG. 1 shows the medium ejecting apparatus 100 in a state where a medium regulating member 105 and a holding member 106 is accommodated. FIG. 2 shows the medium ejecting device 100 in a state where the medium regulating member 105 and the holding member 106 is pulled out.

The medium ejecting apparatus 100 conveys, images, and ejects a medium that is a document. A medium is a paper, a thick paper, a card, a brochure, a passport, etc. A paper or a thick paper includes a small-sized medium such as a business card or a receipt. The small-sized medium is, for example, a medium whose size in a longitudinal direction is a longitudinal size of A8 (74 mm) or less. The small medium may be a medium whose size in a lateral direction is a lateral size of A8 (52 mm) or less, a medium whose size in a longitudinal direction is a longitudinal size of A4 (297 mm) or less, or a medium whose size in the lateral direction is a lateral size of A6 (210 mm) or less, etc. A paper also includes PPC paper, such as A4 size or A3 size.

The medium ejecting apparatus 100 may be a fax machine, a copying machine, a multifunctional peripheral (MFP), etc. A conveyed medium may not be a document but may be an object being printed on etc., and the medium ejecting apparatus 100 may be a printer etc.

The media ejecting device 100 includes a lower housing 101, an upper housing 102, a medium tray 103, an ejection tray 104, the medium regulating member 105 and the holding member 106, etc. An arrow A1 in FIGS. 1 and 2 indicates a medium ejecting direction. An upstream hereinafter refers to an upstream in the medium ejecting direction A1, and a downstream refers to a downstream in the medium ejecting direction A1. A direction perpendicular to the medium ejecting direction A1 may be referred to as a width direction A2. A direction perpendicular to an upper surface of the ejection tray 104 is referred to as a vertical direction A3.

The lower housing 101 and the upper housing 102 are an example of a housing. The upper housing 102 is located at a position covering the upper surface of the medium ejecting apparatus 100 and is engaged with the lower housing 101 by hinges. The upper housing 102 is provided so as to be opened and closed in a direction of an arrow A4 at a time of medium jam, during cleaning the inside of the medium ejecting apparatus 100, etc. The lower housing 101 and the upper housing 102 include an ejection port 101*a* to eject the medium. The upper housing 102 includes an accommodation portion 107 to accommodate the medium regulating member 105 and the holding member 106.

The medium tray 103 is engaged with the lower housing 101 in such a way as to be able to place a medium to be conveyed.

The ejection tray 104 is an example of a tray, and is provided below an ejection port 101*a*, and engages with the lower housing 101 so as to load the medium ejected from the ejection port 101*a*. The ejection tray 104 includes a first tray 104*a*, a second tray 104*b*, a third tray 104*c* and a stopper 104*d*.

The first tray 104*a* is accommodated inside the lower housing 101 when the medium ejecting apparatus 100 is not used. The first tray 104*a* is pulled out from the lower housing 101 in the medium ejecting direction A1, and loads the medium ejected from the ejection port 101*a* when the medium ejecting apparatus 100 is used. The second tray 104*b* is provided so as to be pulled out from the first tray 104*a* in the medium ejecting direction A1 so that a medium having a large size is placed on the ejection tray 104. The third tray 104*c* is provided so as to be able to be pulled out from the second tray 104*b* in the medium ejecting direction A1 so that the medium having a larger size is placed on the ejection tray 104. The first tray 104*a*, the second tray 104*b* and the third tray 104*c* have a first placing surface 104*e*, a second placing surface 104*f* and a third placing surface 104*g* on which the ejected medium is placed, respectively.

The first tray 104*a* includes a plurality of ribs 104*h* and 104*i* extending in the medium ejecting direction A1 on a first placing surface 104*e*. The plurality of ribs 104*h* and 104*i* can reduce a frictional force between the ejected medium and the first placing surface 104*e*, suppress that the medium is caught by the first placing surface 104*e* and is bent, and thereby, suppress that a jam of the medium occurs.

The stopper 104*d* is foldably provided at the downstream end of the third tray 104*c*. The stopper 104*d* stops the front-end of the medium of the maximum size supported by the medium ejecting apparatus 100, for example, the A4 size or the A3 size, ejected on the ejection tray 104, by being raised (stood), and aligns the front-end of each medium. On the other hand, the first tray 104*a*, the second tray 104*b* and the third tray 104*c* can be accommodated in the lower housing 101 when the stopper 104*d* is folded.

The ejection tray 104 may be fixed to the lower housing 101 so as not to be drawn and accommodated. The second tray 104*b* and/or the third tray 104*c* may be omitted. When the third tray 104*c* is omitted, the stopper 104*d* is provided on the second tray 104*b*. When the second tray 104*b* and the third tray 104*c* are omitted, the stopper 104*d* is provided on the first tray 104*a*.

The medium regulating member 105 is a stopper (a stacker supporter) for a small medium, and regulates a position of the front-end of the medium on the ejection tray 104, i.e. a position of an end portion on the downstream side in the medium ejecting direction A1. The holding member 106 holds (supports) the medium regulating member 105, by an end portion on the upstream side engaged with the upper housing 102 and an end portion on the downstream side engaged with the medium regulating member 105. The medium regulating member 105 and the holding member 106 are accommodated in the upper housing 102 and can be drawn out. As shown in FIG. 1, the medium regulating member 105 and the holding member 106 are accommodated in the accommodation portion 107 provided in the upper housing 102, when the medium ejecting apparatus 100 is not used, or when the small-sized medium is not conveyed and ejected. On the other hand, as shown in FIG. 2, the medium regulating member 105 and the holding member 106 are drawn out and used by the user, when the medium ejecting apparatus 100 is used, and when the small-sized medium is conveyed and ejected. A user can use the medium regulating member 105 and the holding member 106 only when necessary, and thereby, the medium ejecting apparatus 100 can improve the convenience of the user.

An extension direction of the medium regulating member 105 drawn from the upper housing 102 and supported by the holding member 106 does not necessarily coincide with a direction in which the medium regulating member 105 is drawn from the upper housing 102. Thus, the medium regulating member 105 is drawn out from the upper housing 102 along the accommodation portion 107, and can contact an appropriate position of the ejection tray 104 after being drawn out from the upper housing 102.

The medium regulating member 105 is provided so as to contact the first tray 104*a* and so as not to contact the second tray 104*b*, in a state where the medium regulating member 105 is pulled out from the upper housing 102. Thus, the medium regulating member 105 is not dragged by the second placing surface 104*f* even when the second tray 104*b* is put into the first tray 104*a* while the medium regulating member 105 is pulled out from the upper housing 102, thereby, the occurrence of the damage of the medium regulating member 105 is suppressed.

The media regulating member 105 is used to stop the front-end of the small-sized medium when the small-sized medium is ejected on the ejection tray 104. Therefore, a distance from the ejection port 101*a* to a potion at which the medium regulating member 105 contacts the ejection tray 104 is set to be less than the maximum size of the medium supported by the medium ejecting apparatus 100 and equal to or larger than the size of the small-sized medium. The maximum size of the medium supported by the medium ejecting apparatus 100 is, for example, a longitudinal size (297 mm) of A4 or a longitudinal size (420 mm) of A3, etc. The size of the small-sized medium is, for example, a longitudinal size of A8 (74 mm) or a lateral size of A8 (52 mm). Thus, the medium regulating member 105 can stop the front-end of the small-sized medium when the small-sized medium is ejected on the ejection tray 104.

On the other hand, a distance from the ejection port 101*a* to the stopper 104*d* is set to be substantially the same as the maximum size of the medium supported by the medium ejecting apparatus 100. Thus, the stopper 104*d* can stop the front-end of the medium when the medium of the maximum size supported by the medium ejecting apparatus 100 is ejected on the ejection tray 104.

Figure 3A:
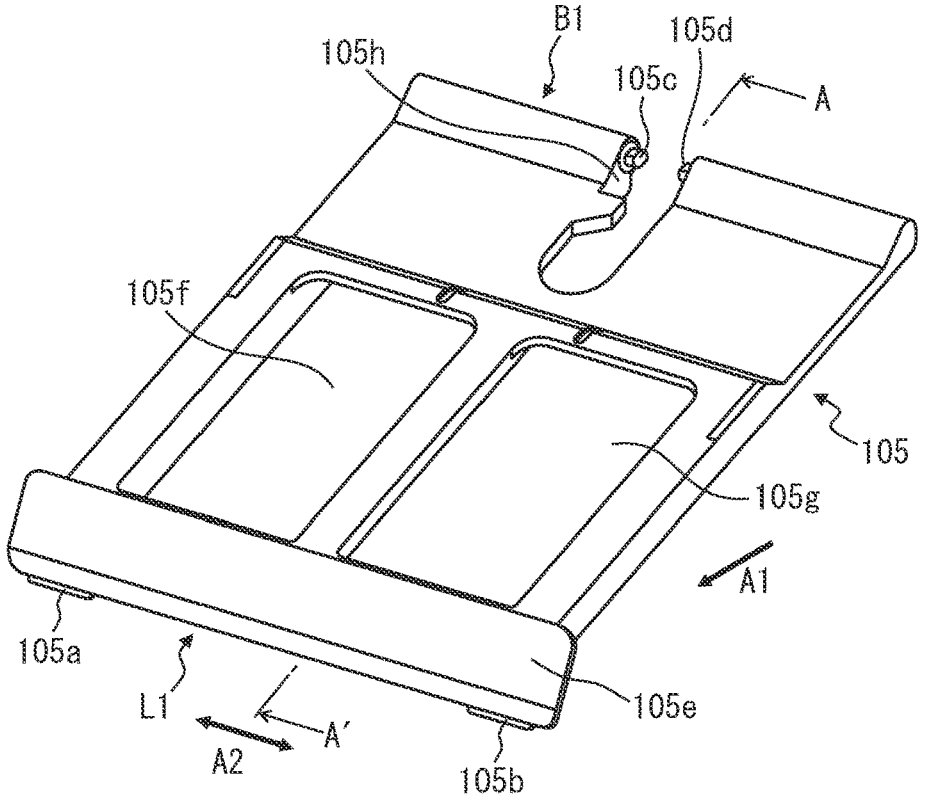
FIG. 3A is a perspective view of a medium regulating member 105.
Figure 3B:
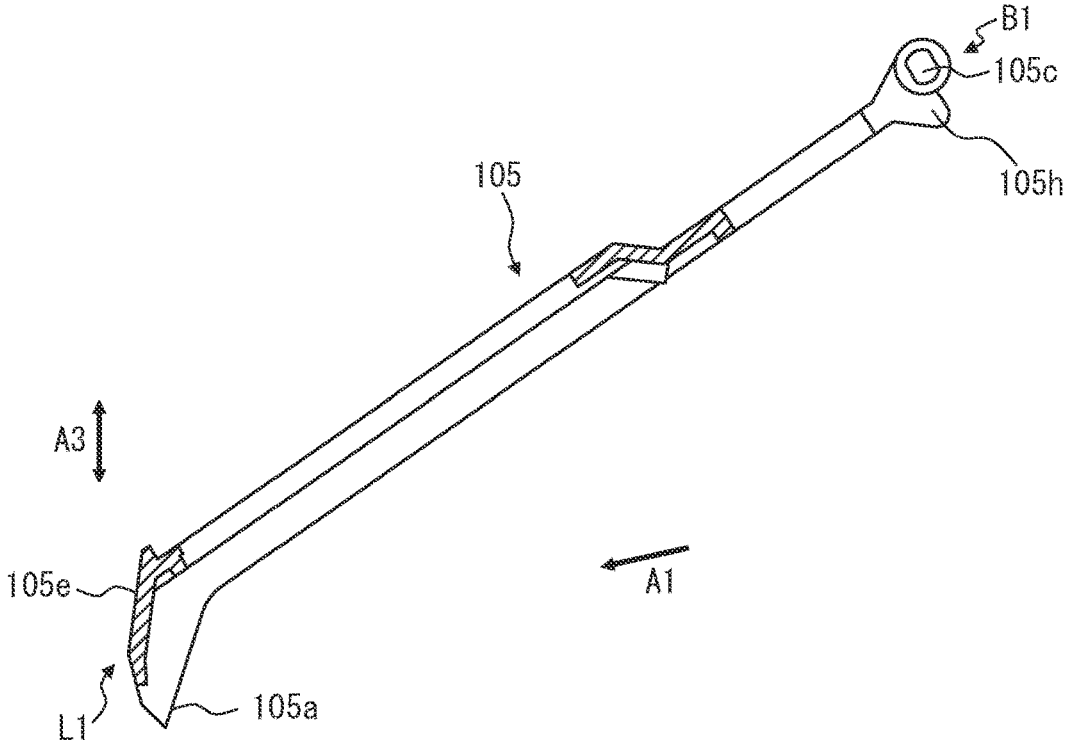
FIG. 3B is a cross-sectional view of the medium regulating member 105.

FIG. 3A is a perspective view of the medium regulating member 105. FIG. 3B is an A-A' cross-sectional view in FIG. 3A.

As shown in FIGS. 3A and 3B, the medium regulating member 105 includes two load pressing portions 105*a*, 105*b*, two engaging portions 105*c*, 105*d*, a front surface portion 105*e*, two openings 105*f*, 105*g*, and a locking portion 105*h*, etc. The medium regulating member 105 is formed of an integral member, such as a resin material or a metal material, etc. The medium regulating member 105 may be formed of a plurality of members.

Each of the load pressing portions 105*a*, 105*b* is provided on the front-end portion L1 side (the downstream side) of the medium regulating member 105. The load pressing portions 105*a*, 105*b* are located apart from each other alongside in the width direction A2 perpendicular to the medium ejecting direction. Each of the load pressing portions 105*a*, 105*b* is provided to apply a load to the medium ejected on the ejection tray 104, and so as to regulate a position of the front-end in the medium ejecting direction A1 of the small-sized medium on the ejection tray 104. Thus, the load pressing portions 105*a*, 105*b* can stop the small-sized medium so that the front-ends of the ejected small-sized media are linearly aligned.

Further, by using the two load pressing portions 105*a*, 105*b*, even when the ejected medium is bent, the medium regulating member 105 can surely contact the medium at the two load pressing portions 105*a*, 105*b*, and can surely press the medium. If the load pressing portion is one, even if the load pressing portion extends over both ends of the width direction A2, when the medium of which a central portion in the width direction A2 is mountain folded is ejected, the mountain folded portion may contact the load pressing portion, and thereby, the medium regulating member may bounce up. In that case, the appearance is impaired. Further, a collision sound generated when the medium collides with the medium regulating member, or a landing sound generated when the bounced medium regulating member lands, may occur. Also, when the medium is a thin paper, the medium may be damaged. Since the medium ejecting apparatus 100 includes a gap between the two load pressing portions 105*a*, 105*b*, even when the medium of which the center portion in the width direction A2 is mountain folded is ejected, the mountain folded portion is suppressed from contacting the medium regulating member 105. Further, even when the front-end of the medium is in wavy state in the width direction A2, the medium ejecting apparatus can acquire the same effect as described above.

A distance between the two load pressing portions 105*a*, 105*b* (a distance between inner end portions of the load pressing portions 105*a*, 105*b*) is set to be less than a width of a medium of the minimum size (a minimum medium width) supported by the medium ejecting apparatus. The minimum medium width is, for example, a longitudinal length or a lateral length of the business card. Thus, when the small-sized medium is ejected, the medium ejecting apparatus 100 can surely stop the small-sized medium by making the small-sized medium surely contact the two load pressing portions 105*a*, 105*b*. On the other hand, if the distance between the two load pressing portions 105*a*, 105*b* is too small, the alignment performance of the small-sized medium is reduced. Therefore, the distance between the two load pressing portions 105*a*, 105*b* is set to a predetermined distance (e.g., 50 mm) or more. The distance between outer end portions of the two load pressing portions 105*a*, 105*b* may be set to be larger than the minimum medium width. Thus, the medium ejecting apparatus 100 can align the small-sized media well.

As shown in FIG. 2, each of the load pressing portions 105*a*, 105*b* is provided so as to contact each of the ribs 104*h*, 104*i* provided on the first placing surface 104*e* of the first tray 104*a*. Thus, each of upper ends of the ribs 104*h*, 104*i* on the first placing surface 104*e* is not located at a position higher than each of lower ends of the load pressing portions 105*a*, 105*b*. Therefore, the medium ejecting device 100 can suppress the medium loaded on the first tray 104*a* from waving in the width direction A2. As a result, the medium ejecting device 100 can suppress the occurrence of the jam of the medium, and suppress the occurrence of the damage of the medium.

If the size in the width direction A2 of each of the load pressing portions 105*a*, 105*b* is too small, a scratch (a rub mark) may occur on the medium, and the jam of the medium may occur. Therefore, the size in the width direction A2 of each of the load pressing portions 105*a*, 105*b* is set to a size such that the scratch does not occur on the medium and a size such that the jam of the medium does not occur. Further, the size in the width direction A2 of each of the load pressing portions 105*a*, 105*b* is set to a size in which each of the load pressing portions 105*a*, 105*b* surely contacts each of the ribs 104*h*, 104*i* even when the medium regulating member 105 swings in a direction parallel to the first placing surface 104*e*.

The number of the load pressing portion is not limited to two, it may be one or more. When the number of the load pressing portion is one, the load pressing portion is formed in a straight line along the width direction A2, so as to contact the front-end of the medium ejected on the ejection tray 104 over both ends of the load pressing portion in the width direction A2. When the number of the load pressing portion is three or more, each of the load pressing portions is located apart from each other alongside in the width direction A2.

Each of the engaging portions 105*c*, 105*d* is provided on the base portion B1 side opposite to the front-end portion L1. The engaging portions 105*c*, 105*d* are located apart from each other alongside in the width direction A2 perpendicular to the medium ejecting direction. Each of the engaging portions 105*c* and 105*d* is formed in a projection shape, and is engaged with the holding member 106.

A distance between the two engaging portions 105*c*, 105*d* is set to be equal to or less than the distance between the two load pressing portions 105*a*, 105*b*, more preferably equal to or less than ⅓ of the distance between the two load pressing portions 105*a*, 105*b*. Thus, the medium ejecting apparatus 100 can properly maintain the balance of the load of the medium regulating member 105. A relationship between the distance between the two engaging portions 105*c*, 105*d* and the balance of the load of the medium regulating member 105 will be described later.

As shown in FIG. 1, the front surface portion 105*e* is provided so as to be flush with the front surface 102*a* of the upper housing 102 in a state in which the medium regulating member 105 is accommodated in the upper housing 102. Thus, the medium ejecting apparatus 100 has a design with a sense of unity in a state where the medium regulating member 105 is accommodated.

Each of the openings 105*f*, 105*g* is provided at a center portion, i.e., between the front-end portion L1 and the base portion B1. Each of the openings 105*f*, 105*g* is provided so as to adjust a load applied from each of the load pressing portions 105*a*, 105*b* to the ejection tray 104. In other words, a position of a center of gravity of the medium regulating member 105 is positioned on the downstream side, and the load applied from each of the load pressing portions 105*a*, 105*b* to the ejection tray 104 is increased, as each of the openings 105*f*, 105*g* is provided on the upstream side. On the other hand, the position of the center of gravity of the medium regulating member 105 is positioned on the upstream side, and the load applied from each of the load pressing portions 105*a*, 105*b* to the ejection tray 104 is reduced, as each of the openings 105*f*, 105*g* is provided on the downstream side. Further, the smaller each of the openings 105*f*, 105*g* is, the larger a weight of the entire medium regulating member 105 is, and the larger the load applied from each of the load pressing portions 105*a*, 105*b* to the ejection tray 104 is. On the other hand, the larger each of the openings 105*f*, 105*g* is, the smaller the weight of the entire medium regulating member 105 is, and the smaller the load applied from each of the load pressing portions 105*a*, 105*b* to the ejection tray 104 is.

The media regulating member 105 is used to stop the front-end of the small-sized medium when the small-sized medium is ejected on the ejection tray 104. A load applied from the load pressing portions 105*a*, 105*b* to the ejection tray 104 is desirably set to a size such that the load pressing portions 105*a*, 105*b* are not floated up by a proceeding force in the medium ejecting direction A1 of the small-sized medium ejected by an ejection roller (i.e., apart from the ejection roller) described later. On the other hand, when the medium of a size larger than the small-sized medium is ejected on the ejection tray 104, the medium regulating member 105 needs to pass the medium without stopping medium so that the medium does not deflect. Therefore, the load applied from the load pressing portions 105*a*, 105*b* to the ejection tray 104 is desirably set to a size such that the load pressing portions 105*a*, 105*b* are floated up by a progressing force in the medium ejecting direction A1 of the medium being ejected by the ejection roller (i.e., in contact with the ejection roller). By the openings 105*f*, 105*g* provided in the medium regulating member 105, the medium ejecting apparatus 100 can appropriately adjust the load applied from the load pressing portions 105*a*, 105*b* to the ejection tray 104 while maintaining a strength of the medium regulating member 105.

Further, by the openings 105*f*, 105*g* provided in the medium regulating member 105, the user can confirm a state of ejecting the medium from the openings 105*f*, 105*g*, and thereby, the medium ejecting device 100 can improve the convenience of the user. The number of openings is not limited to two, it may be one or more. Further, the opening may be omitted.

The locking portion 105*h* is provided on the base portion B1 side. The locking portion 105*h* functions as a stopper so as to prevent the medium regulating member 105 from making an angle equal to or more than a predetermined angle with respect to the holding member 106.

Figure 4A:
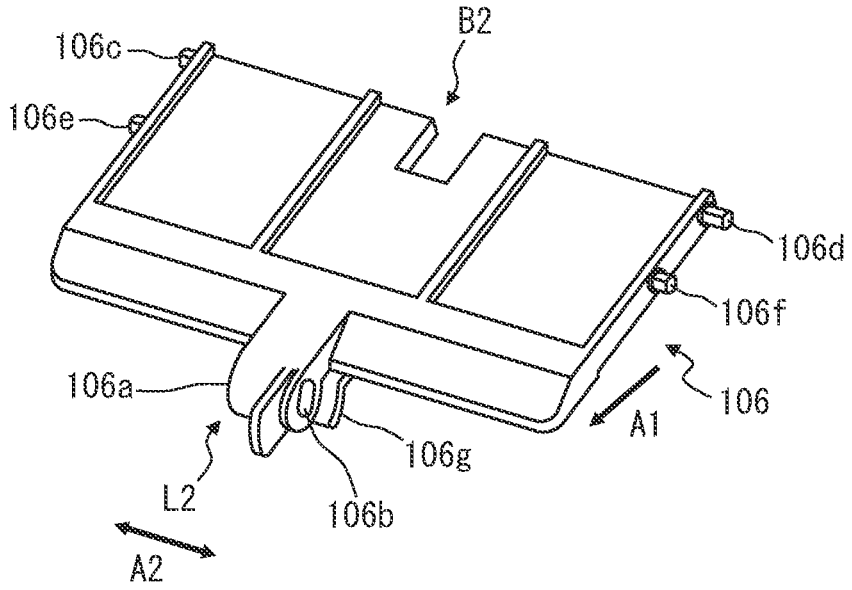
FIG. 4A is a perspective view of a holding member 106.
Figure 4B:
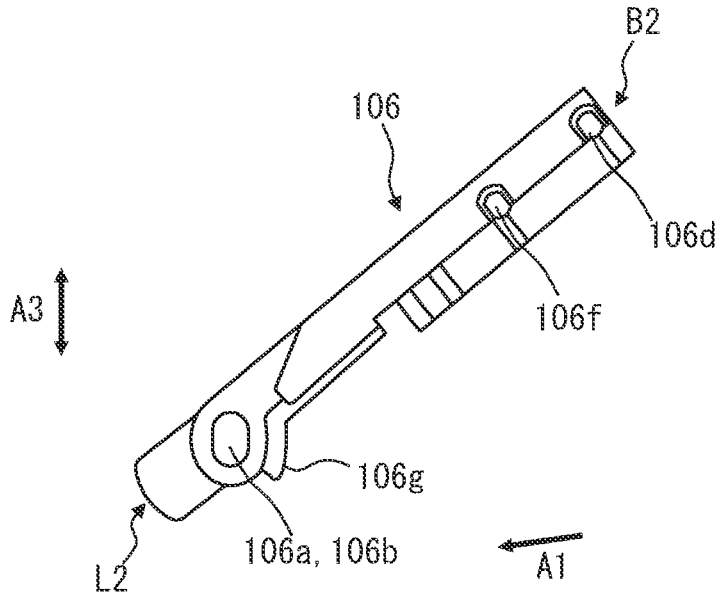
FIG. 4B is a side view of the holding member 106.

FIG. 4A is a perspective view of the holding member 106. FIG. 4B is a side view of the holding member 106.

As shown in FIGS. 4A and 4B, the holding member 106 includes two engaged portions 106*a*, 106*b*, two first protrusion portions 106*c*, 106*d*, two second protrusion portions 106*e*, 106*f*, a locked portion 106*g*, etc. The holding member 106 is formed of an integral member, such as a resin material or a metal material, etc. The holding member 106 may be formed of a plurality of members.

Each of the engaged portions 106*a*, 106*b* is provided on the front-end portion L2 side (the downstream side). The engaged portions 106*a*, 106*b* are located apart from each other alongside in the width direction A2 perpendicular to the medium ejecting direction. Each of the engaged portions 106*a*, 106*b* is a concave portion or a hole portion to engage with each of the engaging portions 105*c*, 105*d* of the medium regulating member 105. Each of the engaged portions 106*a*, 106*b* engages with each of the engaging portions 105*c*, 105*d* so that each of the engaging portions 105*c*, 105*d* can move in the vertical direction A3 with respect to each of the engaged portions 106*a*, 106*b* (within a range of an oblique direction inclined by a predetermined angle with respect to the vertical direction A3). Thus, the engaged portions 106*a*, 106*b* engage with the engaging portions 105*c*, 105*d* in such a way that the medium regulating member 105 can swing in the vertical direction A3.

For example, in the medium ejecting direction A1, a size of the concave portion or the hole portion of each of the engaged portions 106*a*, 106*b* is substantially the same as a size of the protrusion portion of each of the engaging portions 105*c*, 105*d*. On the other hand, in the vertical direction A3 with respect to the first placing surface 104*e* of the first tray 104*a*, a size of the concave portion or the hole portion of each of the engaged portions 106*a*, 106*b* is larger than a size of the protrusion portion of each of the engaging portions 105*c*, 105*d*. For example, when viewed from the side, the protrusion portion of each of the engaging portions 105*c*, 105*d* has a substantially circular shape, and the concave portion or the hole portion of each of the engaged portions 106*a*, 106*b* has an elliptical shape. Thus, each of the engaging portions 105*c*, 105*d* is provided so as to rotate along each of the engaged portions 106*a*, 106*b*, and so as to move in the vertical direction A3 within each of the engaged portions 106*a*, 106*b*.

Each engaged portion of the holding member 106 may be formed in a projection shape similar to the engaging portions 105*c*, 105*d*, and each engaging portion of the medium regulating member 105 may be a concave portion or a hole portion similar to the engaged portions 106*a*, 106*b*. In that case, each engaging portion of the medium regulating member 105 is provided so as to rotate along each engaged portion of the holding member 106, and so as to move in the vertical direction along each engaged portion of the holding member 106.

Further, each engaging portion and each engaged portion may be located on a straight line inclined in the vertical direction A3 with respect to the width direction A2, instead of being located on a straight line extending in the width direction A2. Further, each engaging portion and each engaged portion may be located on a straight line extending in the vertical direction A3. The number of the engaging portion and the engaged portion is not limited to two, and may be one, respectively. In that case, the engaging portion and the engaged portion are formed by, for example, a universal joint, etc., and the engaging portion is provided so as to rotate and move in the vertical direction with respect to the engaged portion.

Each of the first protruding portions 106*c*, 106*d* and each of the second protruding portions 106*e*, 106*f* are provided on the base portion B2 side. Each of the first protruding portions 106*c*, 106*d* and each of the second protruding portions 106*e*, 106*f* is provided to engage with a rail provided in the accommodation portion 107, and so as to slide along the rail. Each of the first protruding portions 106*c*, 106*d* contacts the inside of the front surface 102*a* of the upper housing 102 in a state where the medium regulating member 105 and the holding member 106 are pulled out from the upper housing 102. Thus, the holding member 106 is stopped in the upper housing 102.

The locked portion 106*g* is provided on the front-end portion L2 side. The locked portion 106*g* functions as a stopper, so that the locked portion 106*g* contacts the locking portion 105*h* of the medium regulating member 105, and prevent the medium regulating member 105 from making an angle equal to or more than a predetermined angle with respect to the holding member 106.

Figure 5:
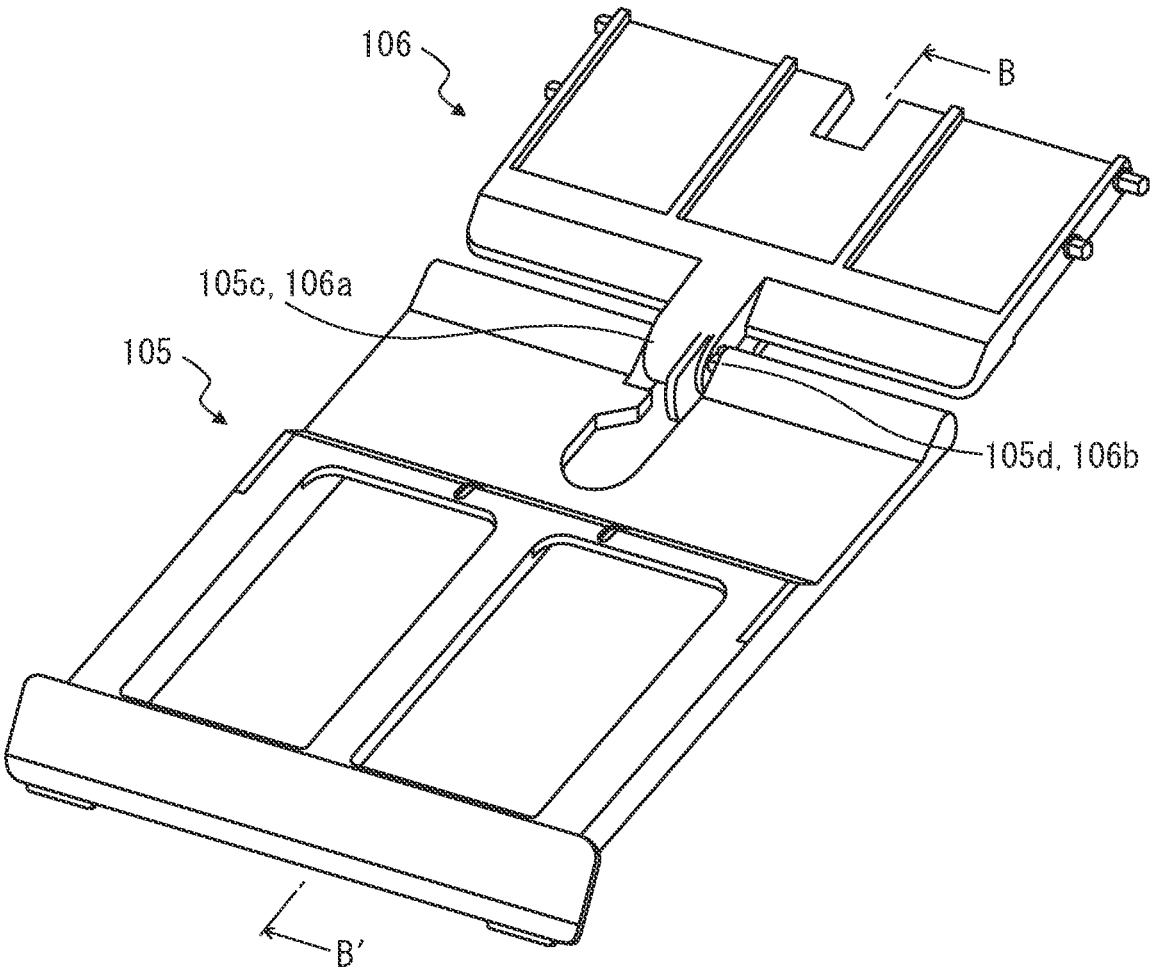
FIG. 5 is a perspective view of the medium regulating member 105 and the holding member 106.

FIG. 5 is a perspective view of the medium regulating member 105 and the holding member 106 in a state of being engaged.

As shown in FIG. 5, the holding member 106 holds the medium regulating member 105 by engaging each of the engaging portions 105*c*, 105*d* with each of the engaged portions 106*a*, 106*b*.

Figure 6A:
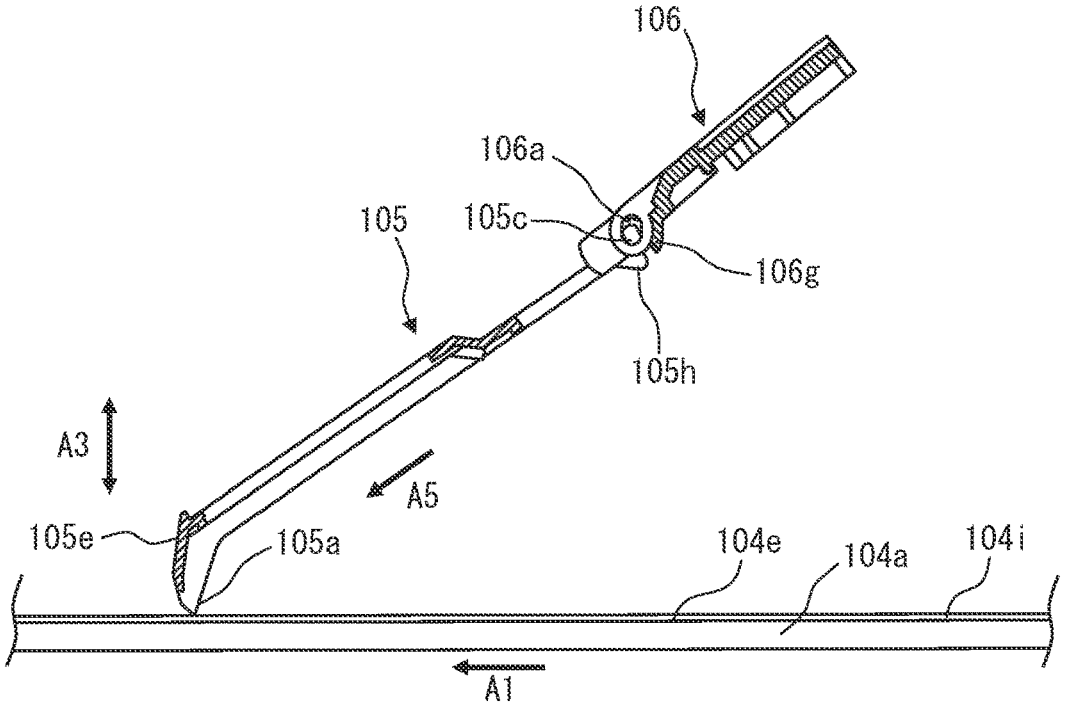
FIG. 6A is a schematic diagram for illustrating an operation of the medium regulating member 105, etc.
Figure 6B:
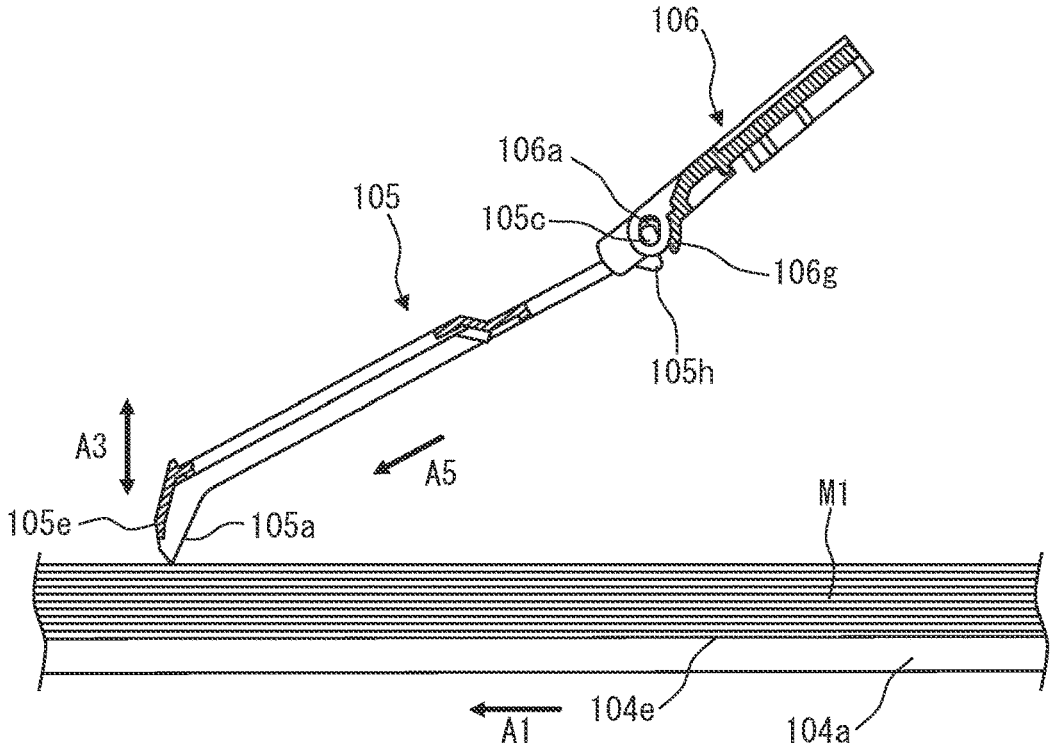
FIG. 6B is a schematic diagram for illustrating the operation of the medium regulating member 105, etc.
Figure 7A:
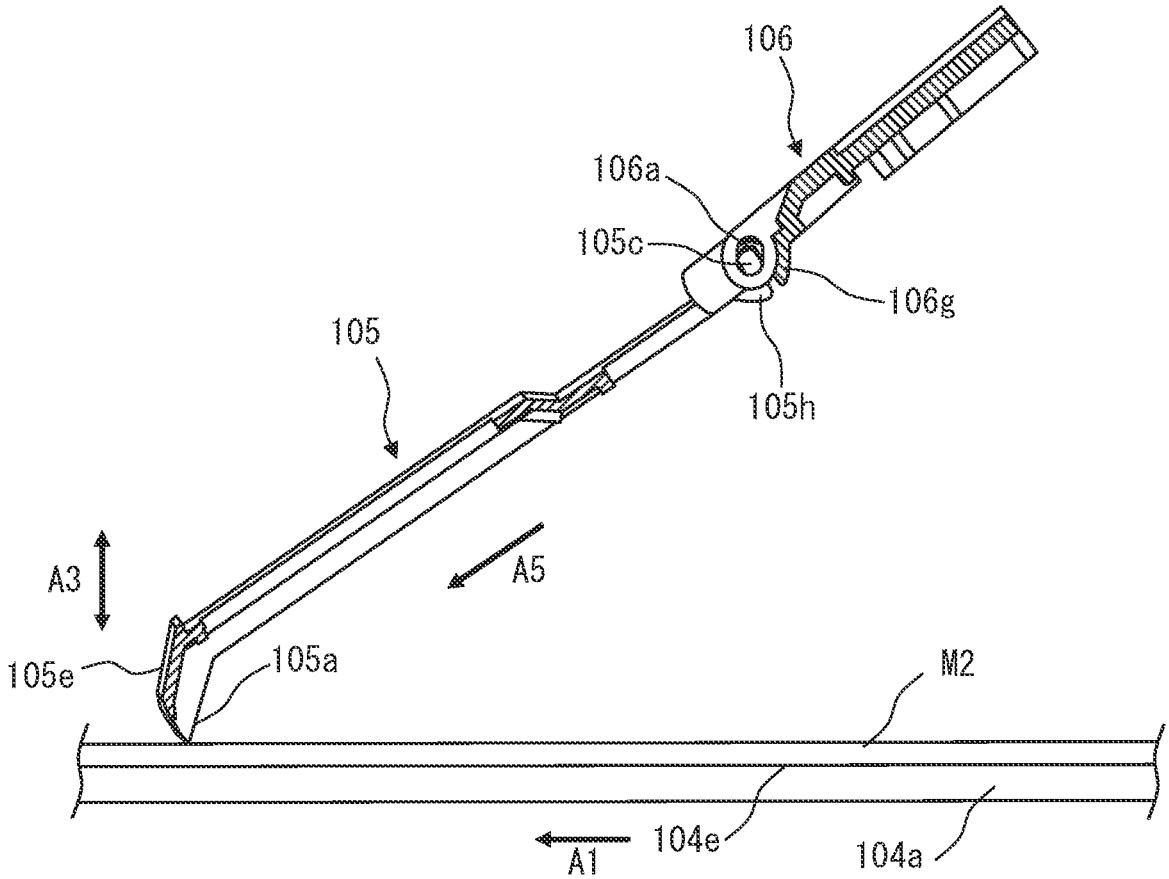
FIG. 7A is a schematic diagram for illustrating the operation of the medium regulating member 105, etc.
Figure 7B:
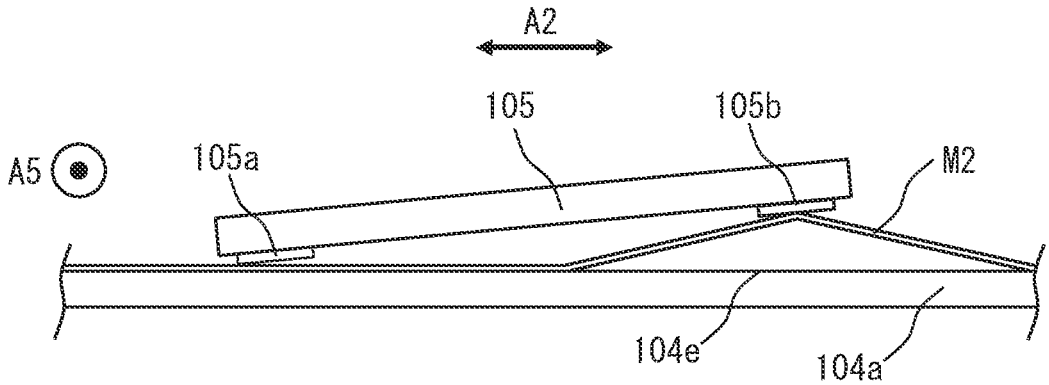
FIG. 7B is a schematic diagram for illustrating the operation of the medium regulating member 105, etc.
Figure 8A:
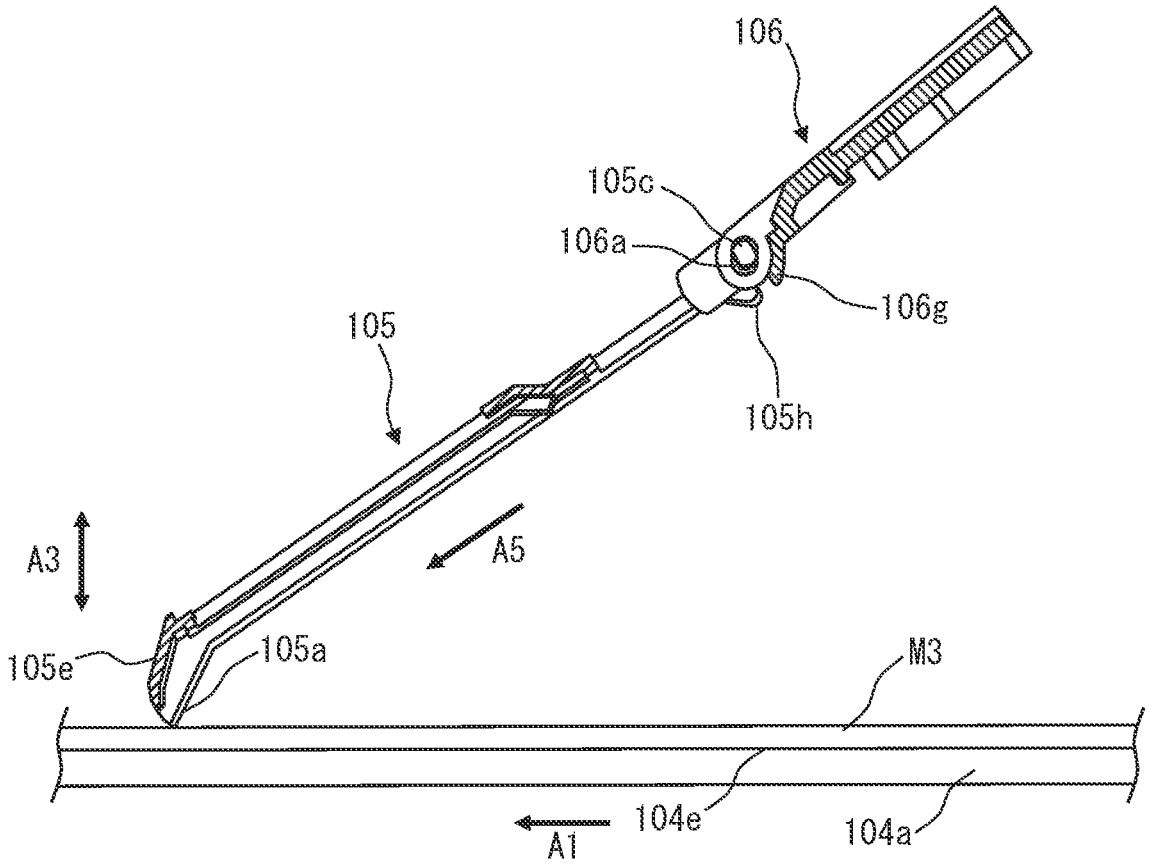
FIG. 8A is a schematic diagram for illustrating the operation of the medium regulating member 105, etc.
Figure 8B:
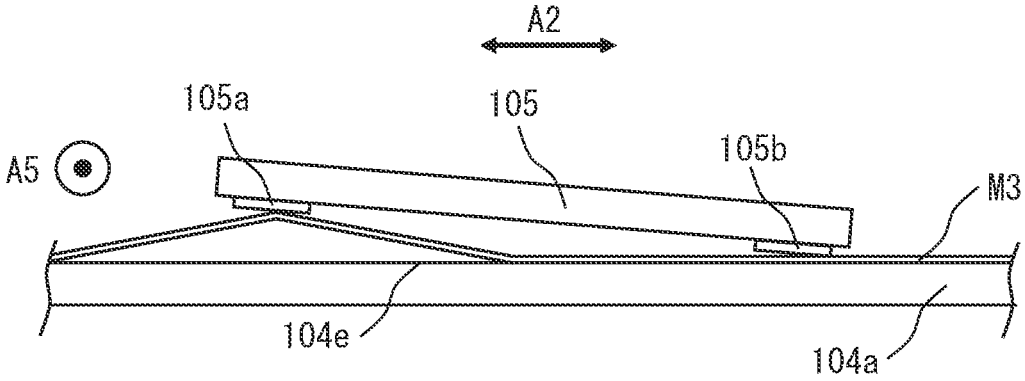
FIG. 8B is a schematic diagram for illustrating the operation of the medium regulating member 105, etc.

FIGS. 6A, 6B, 7A, 7B, 8A and 8B are schematic diagrams for illustrating an operation of the medium regulating member 105 and the holding member 106 during ejecting the medium. FIGS. 6A, 6B, 7A, and 8A are views of the medium regulating member 105 and the holding member 106 as viewed from the side. In FIGS. 6A, 6B, 7A, and 8A, the medium regulating member 105 and the holding member 106 are shown in a B-B' cross-sectional view in FIG. 5. FIGS. 7B and 8B are views of the medium regulating member 105 and the holding member 106 as viewed from the downstream side.

FIG. 6A shows the medium regulating member 105 and the holding member 106 when a medium is not loaded on the ejection tray 104. FIG. 6B shows the medium regulating member 105 and the holding member 106 when a medium M1 larger than the small-sized medium is loaded on the ejection tray 104.

As shown in the FIG. 6A, when a medium is not loaded on the ejection tray 104, the medium regulating member 105 is held by the holding member 106 in a state where each of the load pressing portions 105*a*, 105*b* contacts each of the ribs 104*h*, 104*i* provided on the first placing surface 104*e* of the first tray 104*a*. Thus, the medium regulating member 105 can limit a load applied to the ejection tray 104 to an appropriate size, and thereby, pass the medium larger than the small-sized medium satisfactorily.

On the other hand, as shown in the FIG. 6B, when the medium M1 larger than the small-sized medium is ejected on the ejection tray 104, the ejected medium passes between the load pressing portions 105*a*, 105*b* and the first placing surface 104*e*. As described above, each of the engaging portions 105*c*, 105*d* is provided so as to rotate along each of the engaged portions 106*a*, 106*b*. Therefore, the load pressing portions 105*a*, 105*b* are pushed up by the loaded medium M1, and thereby, the medium regulating member 105 swings upward with respect to the first placing surface 104*e* of the first tray 104*a*. In other words, the holding member 106 holds the medium regulating member 105 in such a way that the medium regulating member 105 can swing in the vertical direction A3 with respect to the upper surface of the ejection tray 104 according to the ejection of the medium. Thus, the medium larger than the small-sized medium can satisfactorily pass through the medium regulating member 105. Further, the medium regulating member 105 is located along the accommodation portion 107 to be accommodated compactly when accommodated in the upper housing 102, the medium regulating member 105 can contact the load pressing portion 105*a*, 105*b* to the ejection tray 104 when drawn out from the upper housing 102.

Further, the medium regulating member 105 is provided so as to swing upward with respect to the holding member 106 when the upper housing 102 is opened in a state where the medium regulating member 105 is pulled out from the upper housing 102. Thus, when the user accidentally opens the upper housing 102 in a state where the medium regulating member 105 is pulled out from the upper housing 102, it is suppressed that the medium regulating member 105 is sandwiched between the upper housing 102 and the ejection tray 104 to be damaged.

FIGS. 7A and 7B shows the medium regulating member 105 and the holding member 106 when a medium M2 which is bent so that one side (the load pressing portion 105*b* side) in the width direction A2 floats up, is loaded on the ejection tray 104. FIGS. 8A and 8B show the medium regulating member 105 and the holding member 106 when a medium M3 which is bent so that the other side (the load pressing portion 105*a* side) in the width direction A2 floats up, is loaded on the ejection tray 104.

As described above, each of the engaging portions 105*c*, 105*d* is provided so as to move in the vertical direction A3 within each of the engaged portions 106*a*, 106*b*. Therefore, as shown in FIGS. 7A and 7B, when the medium M2 which is bent and floats up at the load pressing portion 105*b* side in the width direction A2, is ejected on the ejection tray 104, the load pressing portion 105*b* is pushed up above the load pressing portion 105*a* by the medium M2. Incidentally, since the medium regulating member 105 is a planar rigid body, the medium regulating member 105 is supported by the two load pressing portions 105*a*, 105*b* and one of the engaging portions. The other engaging portion is in a free state where the other engaging portion is not supported at the lower end of the gravity direction, in the case other than satisfying the ideal condition. That is, the medium regulating member 105 is supported by only one of the engaging portions 105*c*, 105*d*.

In the example shown in FIG. 7A, the engaging portion 105*c* is supported by the lower end of the engaged portion 106*a*, and the engaging portion 105*d* is in the free state, and is located at a position between the upper end and the lower end of the engaged portion 106*b* (not shown). Thus, the medium regulating member 105 pivots (rotates, swings) such that the load pressing portion 105*b* side is raised above the load pressing portion 105*a* side. Depending on the position or timing at which the medium M2 contacts each of the load pressing portions 105*a*, 105*b*, the engaging portion 105*d* may contact the upper end of the engaged portion 106*b*, and the engaging portion 105*c* may be in the free state and be located at a position between the upper end and the lower end of the engaged portion 106*a*. Also in this case, the medium regulating member 105 pivots so that the load pressing portion 105*b* side is raised above the load pressing portion 105*a* side.

On the other hand, as shown in FIGS. 8A and 8B, when the medium M3 which is bent and floats up at the load pressing portion 105*a* side in the width direction A2, is ejected on the ejection tray 104, the load pressing portion 105*a* is pushed up above the load pressing portion 105*b* by the medium M3. In the example shown in FIG. 8A, the engaging portion 105*c* is in the free state and is located at a position between the upper end and the lower end of the engaged portion 106*a*, and the engaging portion 105*d* is supported by the lower end of the engaged portion 106*b* (not shown). Thus, the medium regulating member 105 pivots such that the load pressing portion 105*a* side is raised above the load pressing portion 105*b* side. Depending on the position or timing at which the medium M3 contacts each of the load pressing portions 105*a*, 105*b*, the engaging portion 105*c* may contact the upper end of the engaged portion 106*a*, and the engaging portion 105*d* may be in the free state and be located at a position between the upper end and the lower end of the engaged portion 106*b*. Also in this case, the medium regulating member 105 pivots so that the load pressing portion 105*a* side is raised above the load pressing portion 105*b* side.

In other words, the holding member 106 holds the medium regulating member 105 in such a way that the medium regulating member 105 can pivot along a rotation axis in the direction A5 from the base portion B1 side toward the front-end portion L1 side of the medium regulating member 105 according to the ejection of the medium. That is, the medium regulating member 105 is provided so that one end in the width direction A2 swings upward. The medium regulating member 105 has a relief shape in which the medium regulating member 105 swings so that, when the one load pressing portion approaches the first placing surface 104*e*, the other load pressing portion is away from the first placing surface 104*e*. Thus, the medium regulating member 105 can swing in the vertical direction A3 according to the height of the medium when the medium of which the height at each position in the width direction A2 is different, such as the folded medium or medium with pasted photograph, etc., is ejected.

If the medium regulating member does not swing according to the height of the medium, the load of the medium regulating member is concentrated on one of the load pressing portion when the medium of which the height at each position in the width direction A2 is different, is ejected. Thus, the skew may occur by the medium inclined when passing through the medium regulating member, or the jam may occur by the medium that cannot pass through the medium regulating member. The medium regulating member 105 can maintain a good load balance of the medium regulating member 105, and thereby, suppress the occurrence of the skew or the jam of the medium, by swinging in the vertical direction A3 according to the height of the medium.

Figure 9:
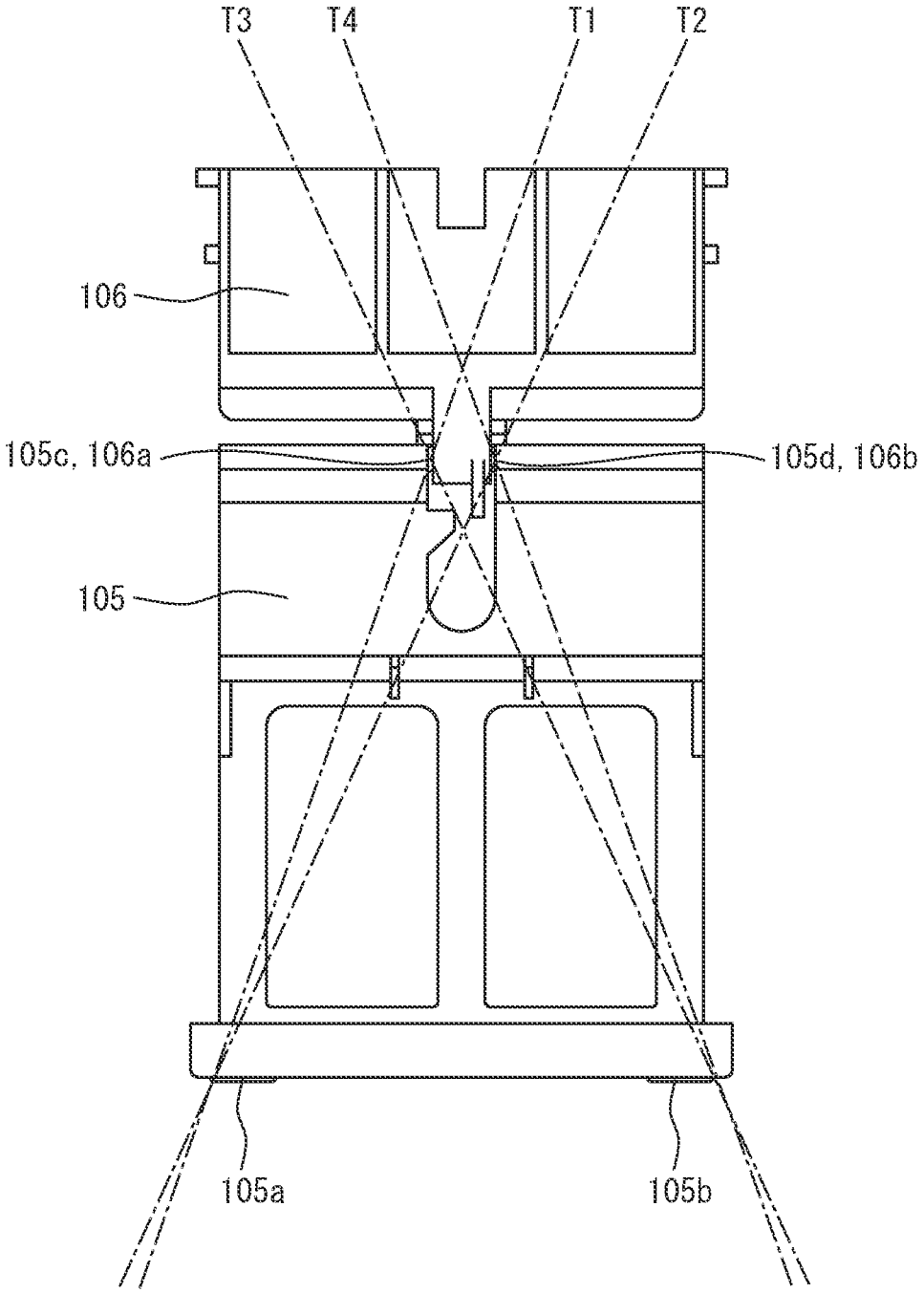
FIG. 9 is a schematic view for illustrating a rotation axis of a pivoting of the medium regulating member 105.

FIG. 9 is a schematic view for illustrating the rotation axis of the pivoting of the medium regulating member 105.

As shown in FIG. 7A, when the load pressing portion 105*b* side is raised and the engaging portion 105*c* contacts the lower end of the engaged portion 106*a*, a straight line T1 passing through the engaging portion 105*c* and the outer end portion in the width direction A2 of the load pressing portion 105*a* is the rotation axis of the pivoting of the medium regulating member 105 in the load pressing portion 105*b*. That is, the load of the load pressing portion 105*b* depends on a self-weight moment acting around the straight line T1 axis. On the other hand, a straight line T3 passing through the engaging portion 105*c* and the outer end portion in the width direction A2 of the load pressing portion 105*b* is the rotation axis of the pivoting of the medium regulating member 105 in the load pressing portion 105*a*. That is, the load of the load pressing portion 105*a* at that time depends on the self-weight moment acting around the straight line T3 axis.

As shown in FIG. 8A, when the load pressing portion 105*a* side is raised and the engaging portion 105*d* contacts the lower end of the engaged portion 106*b*, the straight line T4 passing through the engaging portion 105*d* and the outer end portion in the width direction A2 of the load pressing portion 105*b* is the rotation axis of the pivoting of the medium regulating member 105 in the load pressing portion 105*a*. That is, the load of the load pressing portion 105*a* depends on a self-weight moment acting around the straight line T4 axis. On the other hand, a straight line T2 passing through the engaging portion 105*d* and the outer end portion in the width direction A2 of the load pressing portion 105*a* is the rotation axis of the pivoting of the medium regulating member 105 in the load pressing portion 105*b*. That is, the load of the load pressing portion 105*b* at that time depends on the self-weight moment acting around the straight line T2 axis.

Figure 10A:
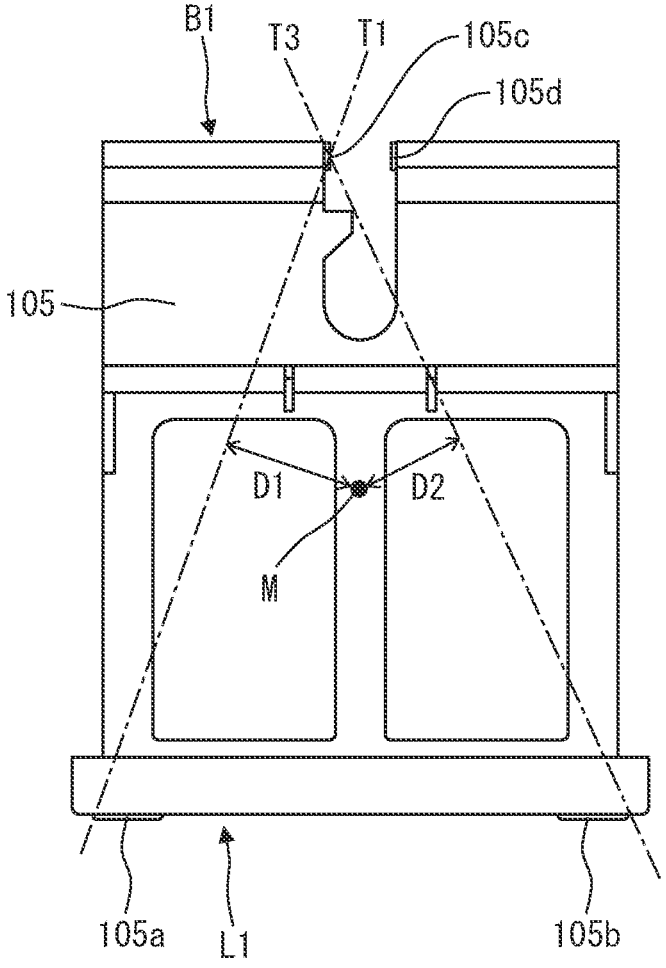
FIG. 10A is a schematic diagram for illustrating a balance of a load.
Figure 10B:
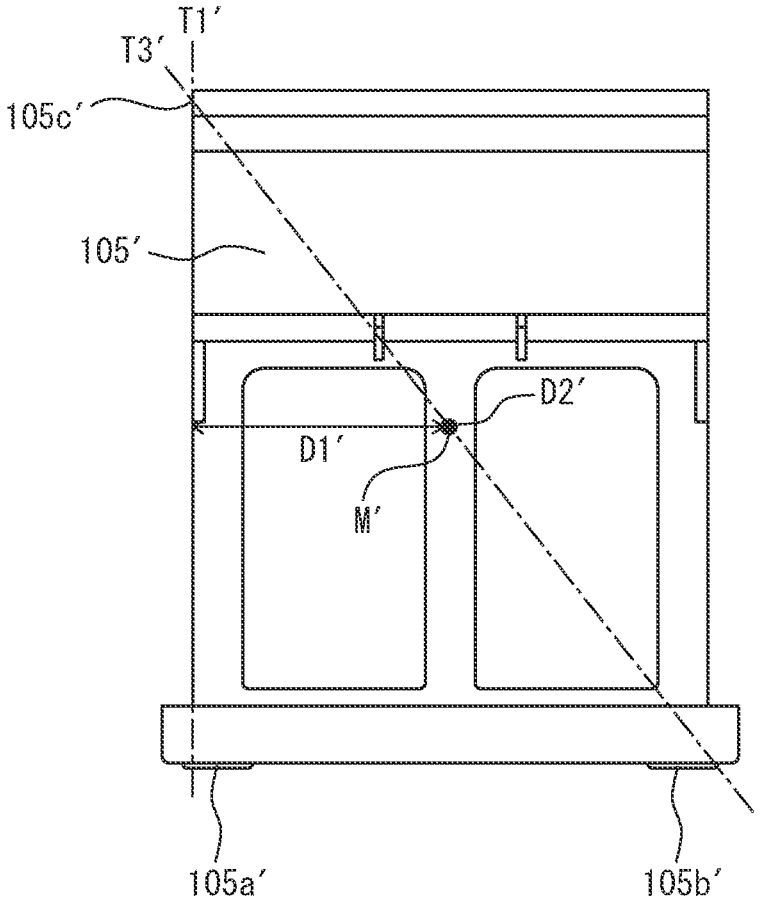
FIG. 10B is a schematic diagram for illustrating the balance of the load.

FIGS. 10A and 10B are schematic diagrams for illustrating the balance of the load of the medium regulating member 105.

As shown in the FIG. 10A, when the straight line T1 passing through the engaging portion 105*c* and the outer end portion of the load pressing portion 105*a* is the rotation axis, the self-weight moment (rotation moment by the rotation axis T1) acts on the load pressing portion 105*b* located on the opposite side of the load pressing portion 105*a*. The magnitude of the self-weight moment is a value (m×D1) acquired by multiplying the weight m of the medium regulating member 105 by a distance D1 between the rotation axis T1 and a position M of a center of gravity. On the other hand, when the straight line T3 passing through the engaging portion 105*c* and the outer end portion of the load pressing portion 105*b* is the rotation axis, the self-weight moment (rotation moment by the rotation axis T3) acts on the load pressing portion 105*a* located on the opposite side of the load pressing portion 105*b*. The magnitude of the self-weight moment is a value (m×D2) acquired by multiplying the weight m of the medium regulating member 105 by a distance D2 between the rotation axis T3 and a position M of a center of gravity.

If the rotation moment by the rotation axis T1 is too large, the load applied to the load pressing portion 105*b* when the load pressing portion 105*b* side is raised, becomes too large, and the pressing force applied to a position contacting the load pressing portion 105*b* in the medium becomes too large. On the other hand, if the rotation moment by the rotation axis T3 is too large, the load applied to the load pressing portion 105*a* when the load pressing portion 105*a* side is raised, becomes too large, and the pressing force applied to a position contacting the load pressing portion 105*a* in the medium becomes too large. Therefore, a magnitude of the rotation moment by the rotation axis T3 and a magnitude of the rotation moment by the rotation axis T1, are desirably set so as to approximate to each other. Since the engaging portion 105*c* is located in the center portion (within a predetermined range from the center position) in the width direction A2 of the medium regulating member 105, the distances D1 and D2 are approximate to each other, and the magnitude of the rotation moment by the rotation axis T1 and the magnitude of the rotation moment by the rotation axis T3 are approximate to each other.

FIG. 10B shows a medium regulating member 105' in which an engaging portion 105*c'* is located at an end portion in the width direction A2. In a medium regulating member 105', when a load pressing portion 105*b'* side is raised and the engaging portion 105*c'* contacts a lower end of an engaged portion, a straight line T1' passing through the engaging portion 105*c'* and an outer end in the width direction A2 of a load pressing portion 105*a'* is a rotation axis of the pivoting of the medium regulating member 105' in the load pressing portion 105*b'*. That is, the load of the load pressing portion 105*b'* depends on a self-weight moment acting around the straight line T1' axis. On the other hand, a straight line T3' passing through the engaging portion 105*c*' and an outer end portion in the width direction A2 of the load pressing portion 105*b*' is a rotation axis of the medium regulating member 105' in the load pressing portion 105*a*'. That is, the load of the load pressing portion 105*a*' at that time depends on a self-weight moment acting around the straight line T3' axis.

As shown in FIGS. 10A and 10B, a distance D1' between the rotation axis T1' and a position M' of a center of gravity when the engaging portion 105*c*' is located at the end portion in the width direction A2 is larger than the distance D1 between the rotation axis T1 and the position M of the center of gravity when the engaging portion 105*c* is located at the center portion in the width direction A2. On the other hand, a distance D2' between the rotation axis T3' and the position M' of the center of gravity when the engaging portion 105*c*' is located at the end portion in the width direction A2 is smaller than the distance D2 between the rotation axis T3 and the position M of the center of gravity when the engaging portion 105*c* is located at the center portion in the width direction A2. When the difference between the distance D1' and the distance D2' is increased, a difference between a magnitude of a rotation moment by the rotation axis T1' and a magnitude of a rotation moment by the rotation axis T3' is increased.

In the medium ejecting apparatus 100, since the engaging portion 105*c* is located in the center portion in the width direction A2 of the medium regulating member 105, each magnitude of the self-weight moment applied to each load pressing portion in the case where the load pressing portion 105*b* side is raised and in the case where the load pressing portion 105*a* side is raised, is approximated. Therefore, each load applied to each load pressing portion in the case where the load pressing portion 105*b* side is raised and in the case where the load pressing portion 105*a* side is raised, is approximated. In this case, the sum of the difference between the loads applied to the load pressing portions 105*a*, 105*b* when the load pressing portion 105*b* side is raised and the difference between the loads applied to the load pressing portions 105*a* and 105*b* when the load pressing portion 105*a* side is raised, is small. Therefore, the medium regulating member 105 can maintain a good balance between the left and right sides.

Similarly, when the straight line T2 passing through the engaging portion 105*d* and the outer end portion of the load pressing portion 105*a* is a rotation axis, the self-weight moment (rotation moment by the rotation axis T2) acts on the load pressing portion 105*b* located on the opposite side of the load pressing portion 105*a*. On the other hand, when the straight line T4 passing through the engaging portion 105*d* and the outer end portion of the load pressing portion 105*b* becomes the rotation axis, the self-weight moment (rotation moment by the rotation axis T4) acts on the load pressing portion 105*a* located on the opposite side of the load pressing portion 105*b*. In the medium ejecting apparatus 100, since the engaging portion 105*d* is located in the center portion in the width direction A2 of the medium regulating member 105, each magnitude of the self-weight moment applied to the load pressing portion on the opposite side in the case where the load pressing portion 105*b* side is raised and in the case where the load pressing portion 105*a* side is raised, is approximated. Therefore, each load applied to the load pressing portion on the opposite side in the case where the load pressing portion 105*b* side is raised and in the case where the load pressing portion 105*a* side is raised, is approximated, and the medium regulating member 105 can maintain a good balance between the left and right sides.

Incidentally, as the position M of the center of gravity is close to the front-end portion L1, the ratio of the distance D1 and the distance D2 is close to 1. As the position M of the center of gravity is close to the base portion B1, the radio of the distance D1 and the distance D2 is away from 1. Therefore, in order to maintain a good balance between the left and right sides of the medium regulating member 105, the position M of the center of gravity is preferably located in the vicinity of the front-end portion L1. However, as the position M of the center of gravity is close to the front-end portion L1, the load at the front-end of the medium regulating member 105 is increased, the strength and the rigidity of the medium regulating member 105 is reduced (the medium regulating member 105 is easily damaged and easily deformed). Therefore, the position M of the center of gravity is preferably located at the center position of the medium regulating member 105 in the medium ejecting direction A1.

Figure 11:
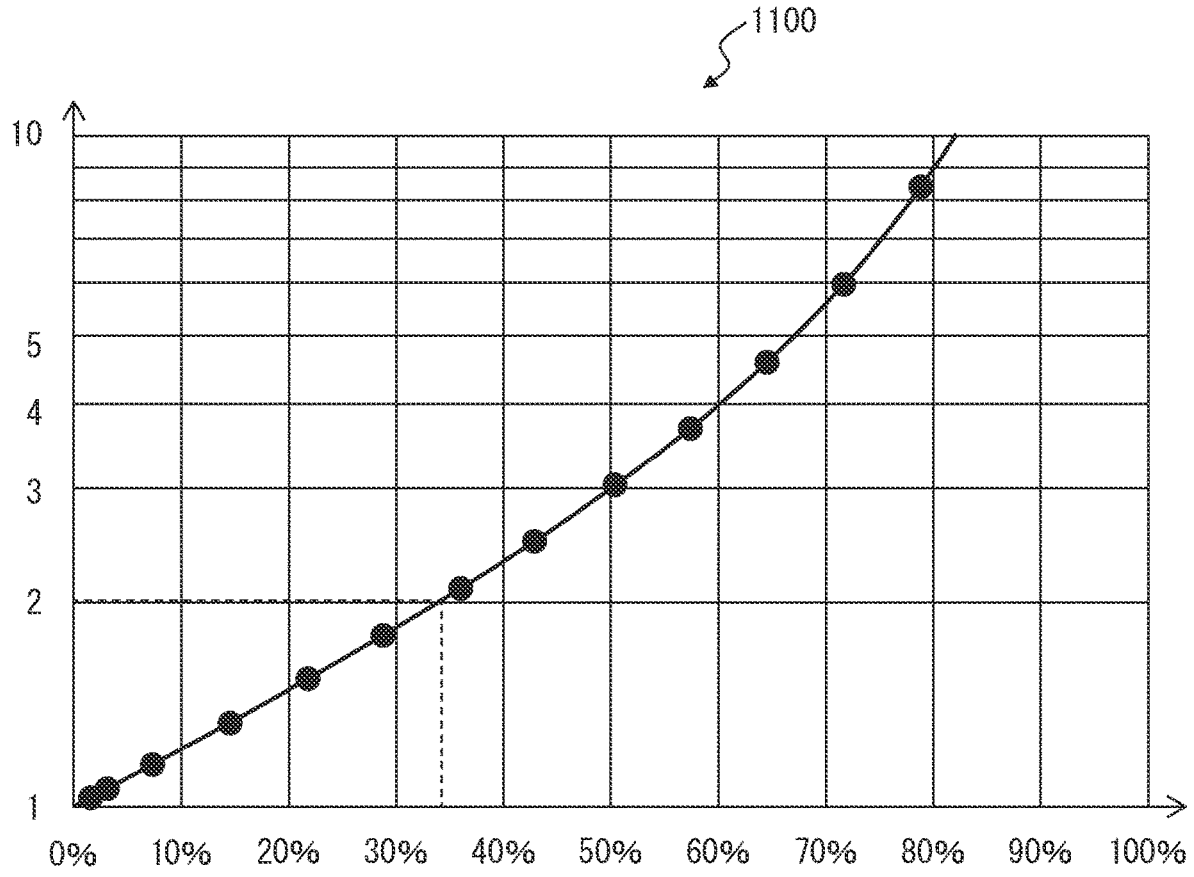
FIG. 11 is a graph 1100 showing a ratio of the load.

FIG. 11 is a graph 1100 showing the ratio of each load applied to each load pressing portion in the medium regulating member 105 in which the position M of the center of gravity is located at the center position of the medium ejecting direction A1.

The horizontal axis of the graph 1100 indicates the ratio of the distance between the engaging portions 105*c*, 105*d* to the distance between the load pressing portions 105*a*, 105*b* in the width direction A2. The vertical axis of the graph 1100 indicates the ratio of the load applied to the load pressing portion 105*b* when the load pressing portion 105*b* is raised to the load applied to the load pressing portion 105*a* when the load pressing portion 105*a* is raised. As shown in graph 1100, the smaller the ratio of the distance is, the smaller the ratio of the load is. The larger the ratio of the distance is, the larger the ratio of the load is. As shown in the graph 1100, when the distance between the engaging portions 105*c*, 105*d* is equal to or less than ⅓ of the distance between the load pressing portions 105*a*, 105*b*, the ratio of the load is ½ or less. Thus, the medium regulating member 105 can maintain a good balance between the left and right sides.

Figure 12:
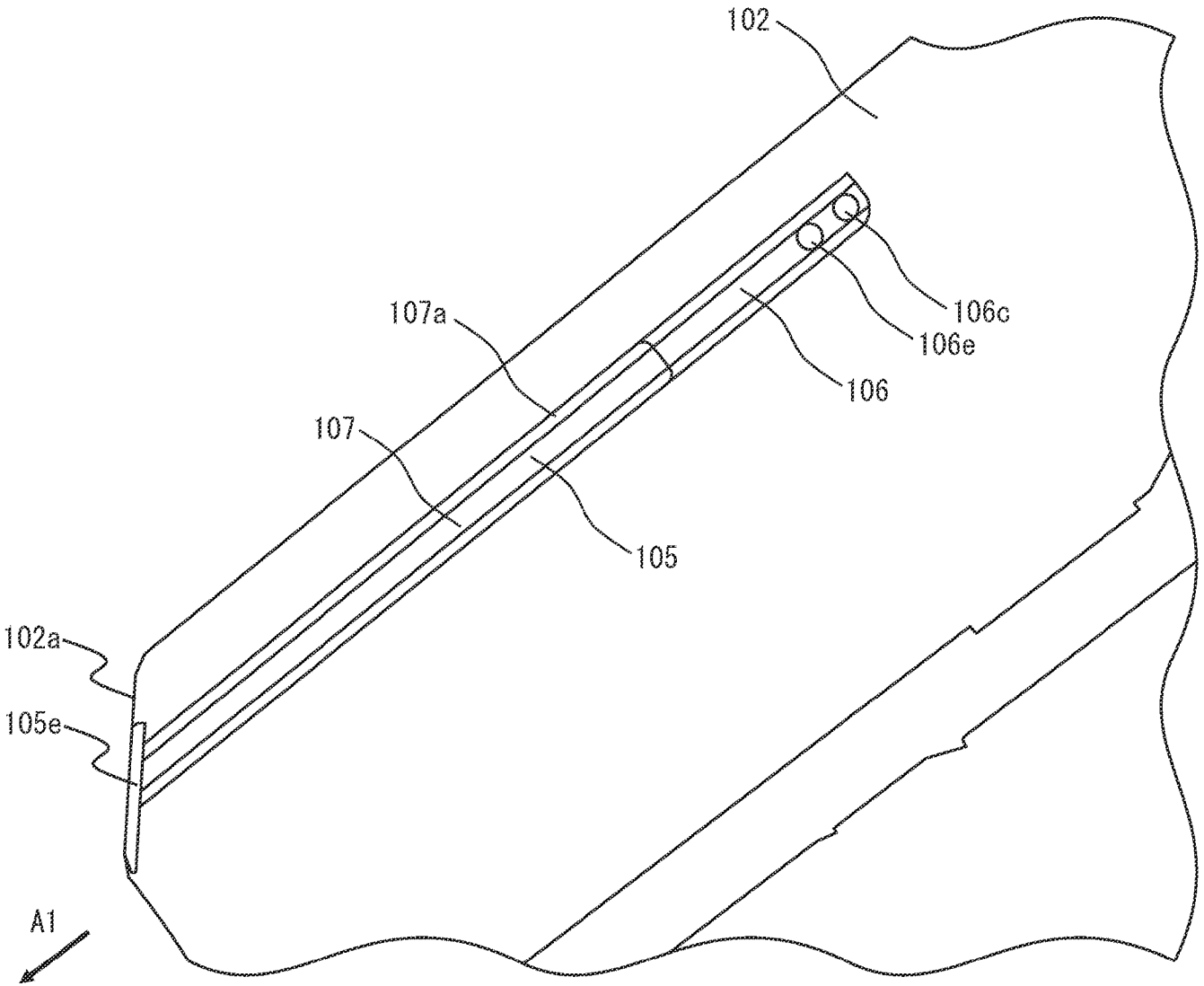
FIG. 12 is a schematic diagram of an inside of the upper housing 102 as viewed from the side.

FIG. 12 is a schematic view of the inside of the upper housing 102 in a state where the medium regulating member 105 and the holding member 106 is accommodated in the upper housing 102 as viewed from the side.

As shown in FIG. 12, the accommodation portion 107 includes a guide member 107*a* formed by a rail formed linearly. When the medium regulating member 105 and the holding member 106 are accommodated in the accommodating portion 107, the medium regulating member 105 and the holding member 106 are located linearly along the guide member 107*a*. On the other hand, when the medium regulating member 105 and the holding member 106 are pulled out from the accommodating portion 107, the medium regulating member 105 and the holding member 106 slide, by the first projecting portions 106*c*, 106*d* and the second projecting portions 106*e*, 106*f* moving along the guide member 107*a*. Thus, the medium ejecting apparatus 100 can sufficiently reduce the space in the height direction of the accommodation portion 107, and can reduce the device size.

As described above, the front surface 105*e* of the medium regulating member 105 and the front surface 102*a* of the upper housing 102 are arranged so as to be flush with each other in a state where the medium regulating member 105 is accommodated in the upper housing 102. Thus, the medium ejecting apparatus 100 has a design with a sense of unity in a state where the medium regulating member 105 is accommodated.

Figure 13:
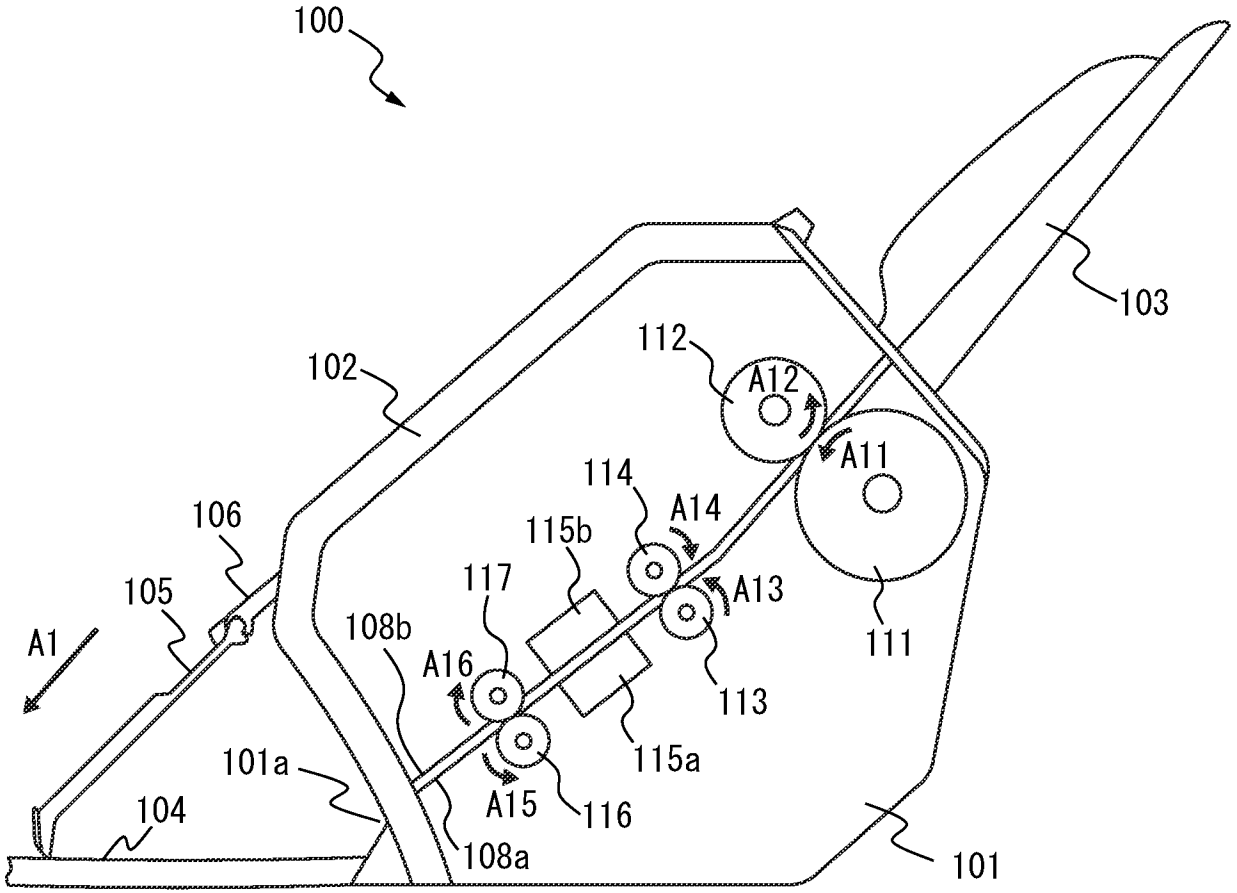
FIG. 13 is a diagram for illustrating a conveyance path inside the medium ejecting apparatus 100.

FIG. 13 is a diagram for illustrating a conveyance path inside the medium ejecting apparatus 100.

The conveyance path inside the medium ejecting apparatus 100 includes a feed roller 111, a brake roller 112, a first conveyance roller 113, a second conveyance roller 114, a first imaging device 115*a*, a second imaging device 115*b*, a first ejection roller 116 and a second ejection roller 117, etc. The number of each roller is not limited to one, and may be plural. A top surface of the lower housing 101 forms a lower guide 108*a* of a conveyance path of a medium, and a bottom surface of the upper housing 102 forms an upper guide 108*b* of the conveyance path of a medium.

The first imaging device 115*a* includes a line sensor based on a unity-magnification optical system type contact image sensor (CIS) including an imaging element based on a complementary metal oxide semiconductor (CMOS) linearly located in a main scanning direction. Further, the first imaging device 115*a* includes a lens for forming an image on the imaging element, and an A/D converter for amplifying and analog-digital (A/D) converting an electric signal output from the imaging element. The first imaging device 115*a* generates and outputs an input image imaging a front surface of a conveyed medium, in accordance with control from a processing circuit (not shown).

Similarly, the second imaging device 115*b* includes a line sensor based on a unity-magnification optical system type CIS including an imaging element based on a CMOS linearly located in a main scanning direction. Further, the second imaging device 115*b* includes a lens for forming an image on the imaging element, and an A/D converter for amplifying and A/D converting an electric signal output from the imaging element. The second imaging device 115*b* generates and outputs an input image imaging a back surface of a conveyed medium, in accordance with control from a processing circuit (not shown).

Only either of the first imaging device 115*a* and the second imaging device 115*b* may be located in the medium ejecting apparatus 100 and only one surface of a medium may be read. Further, a line sensor based on a unity-magnification optical system type CIS including an imaging element based on charge coupled devices (CCDs) may be used in place of the line sensor based on a unity-magnification optical system type CIS including an imaging element based on a CMOS. Further, a line sensor based on a reduction optical system type line sensor including an imaging element based on CMOS or CCDs.

The medium placed on the medium tray 103 is conveyed between the lower guide 108*a* and the upper guide 108*b* in the medium ejecting direction A1 by the feeding roller 111 rotating in a direction of an arrow A11 in FIG. 13. When the medium is conveyed, the brake roller 112 rotates in a direction of an arrow A12. By the workings of the feed roller 111 and the brake roller 112, when a plurality of media are placed on the medium tray 103, only a medium in contact with the feed roller 111, out of the media placed on the medium tray 103, is separated. Consequently, conveyance of a medium other than the separated medium is restricted (prevention of multi-feed)

The medium is fed between the first conveyance roller 113 and the second conveyance roller 114 while being guided by the lower guide 108*a* and the upper guide 108*b*. The medium is fed between the first imaging device 115*a* and the second imaging device 115*b* by the first conveyance roller 113 and the second conveyance roller 114 rotating in directions of an arrow A13 and an arrow A14, respectively, and is read by the first imaging device 115*a* and the second imaging device 115*b*. The first ejecting roller 116 and the second ejecting roller 117 eject the medium on the ejection tray 104 by rotating in directions of arrows A15 and A16, respectively. The ejection tray 104 loads the medium ejected by the first ejecting roller 116 and the second ejecting roller 117.

As described above in detail, the medium ejecting device 100 holds the medium regulating member 105 to regulate the front-end position of the medium ejected on the ejection tray 104 in such a way that the medium regulating member 105 can swing in the vertical direction A3 and pivot along the rotation axis of the extending direction. Thus, when the medium of a specific size or more is ejected, the medium ejecting apparatus 100 passes the medium through the medium regulating member 105. Further, when the height at each position in the width direction A2 in the medium is different, the medium regulating member 105 swings in the vertical direction A3 according to the height. Therefore, the medium ejecting apparatus 100 can satisfactorily load the ejected medium on the tray, while satisfactorily aligning the end of the particular medium, particularly the medium smaller than a particular size.

In particular, the medium ejecting apparatus 100 allows the medium regulating member 105 to contact the ejected medium with good balance, without being affected by tolerance of each component in the apparatus, or tolerance generated during assembling the apparatus, etc., and thereby, suppress the occurrence of the skew or the jam of the medium. Further, the medium ejecting device 100 allows the medium regulating member 105 to contact the ejected medium with good balance even when the thin paper, etc., is conveyed, and thereby, suppress the occurrence of the jam of the medium.

In particular, since the medium ejecting apparatus 100 stops the small-sized medium by the medium regulating member 105, it is suppressed that the small-sized medium that has been previously ejected is extruded by the small-sized medium ejected later. Further, it is suppressed that the later ejected small-sized medium slips under the extruded small-sized medium and an order of the media is changed, as a result of the previously ejected small-sized medium being extruded. Further, by the medium regulating member 105, the ejected small-sized medium is prevented from popping out from the ejection tray 104. Thus, the user can easily align the plurality of ejected media, thereby, the medium ejecting apparatus 100 can improve the convenience of the user and reduce the total time required for the medium reading processing.

Further, since the medium regulating member 105 can be accommodated in the upper housing 102 when not in use, the medium ejecting apparatus 100 can reduce a possibility that the medium regulating member 105 is lost when not in use. Further, since the user can accommodate the medium regulating member 105 when opening and closing the upper housing 102, the medium ejecting apparatus 100 can suppress that the opening and closing of the upper housing 102 is prevented by the medium regulating member 105.

According to the present invention, the medium ejecting apparatus can satisfactorily load the ejected medium on the tray while satisfactorily aligning the end of the specific medium.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A medium ejecting apparatus comprising:

an ejection roller to eject a medium;

a tray to load the medium ejected by the ejection roller on a placing surface;

a medium regulating member provided with load pressing portions to contact the placing surface, in a status where a medium is not placed on the tray, on a front-end side thereof to apply a load to the medium ejected on the tray by the ejection roller, and provided with two engaging portions located apart from each other in a direction perpendicular to a medium ejecting direction on a base portion side opposite to the front-end portion; and a holding member provided with two engaged portions located apart from each other in the direction perpendicular to the medium ejecting direction to engage with the two engaging portions respectively, to hold the medium regulating member in such a way that the medium regulating member can swing in a vertical direction with respect to an upper surface of the tray, and pivot along a rotation axis in a direction from the base side toward the front-end portion side by a first side of the holding member and a second side of the holding member in a direction perpendicular to a medium ejecting direction pivoting in conjunction with each other so that the first side and the second side are located at heights different from each other when a first height at a first position in the medium facing the first side and a second height at a second position in the medium facing the second side are different, when the medium is being ejected, wherein a distance between the two of the engaging portions is equal to or less than 1/3 of a distance between two of the load pressing portions.

2. The medium ejecting apparatus according to claim 1, wherein the medium regulating member is provided with two of the load pressing portions located apart from each other in a direction perpendicular to a medium ejecting direction.

3. The medium ejecting apparatus according to claim 2, wherein a distance between the two of the load pressing portions is less than the minimum medium width supported by the medium ejecting apparatus.

4. The medium ejecting apparatus according to claim 1, wherein the tray includes a rib extending in a medium ejecting direction, to contact a load pressing portion.

5. The medium ejecting apparatus according to claim 1, wherein the medium regulating member and the holding member are accommodated in a housing of the medium ejecting apparatus and can be drawn out.

6. A medium ejecting apparatus comprising:

an ejection roller to eject a medium;

a tray to load the medium ejected by the ejection roller on a placing surface;

a medium regulating member provided with two load pressing portions located apart from each other in a direction perpendicular to a medium ejecting direction to contact the placing surface, in a status where a medium is not placed on the tray, on a front-end side thereof to apply a load to the medium ejected on the tray by the ejection roller, and provided with two engaging portions located apart from each other in the direction perpendicular to the medium ejecting direction on a base portion side opposite to the front-end portion; and a holding member provided with an engaged portion to engage with the engaging portion, to hold the medium regulating member in such a way that the medium regulating member can swing in a vertical direction with respect to an upper surface of the tray, and pivot along a rotation axis in a direction from the base side toward the front-end portion side by a first side of the holding member and a second side of the holding member in a direction perpendicular to a medium ejecting direction pivoting in conjunction with each other so that the first side and the second side are located at heights different from each other when a first height at a first position in the medium facing the first side and a second height at a second position in the medium facing the second side are different, when the medium is being ejected, wherein a distance between the two engaging portions is equal to or less than ⅓ of a distance between the two load pressing portions.

* * * * *